US012098541B2

(12) United States Patent
Schluter

(10) Patent No.: US 12,098,541 B2
(45) Date of Patent: Sep. 24, 2024

(54) EXPANSION JOINT PROFILE SYSTEM

(71) Applicant: Schluter Systems L.P., Plattsburgh, NY (US)

(72) Inventor: Werner Schluter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 120 days.

(21) Appl. No.: 17/356,631

(22) Filed: Jun. 24, 2021

(65) Prior Publication Data

US 2022/0010548 A1 Jan. 13, 2022

(30) Foreign Application Priority Data

Jun. 26, 2020 (DE) ..... 202020103699.8

(51) Int. Cl.
*E04B 1/68* (2006.01)
*E04B 1/00* (2006.01)

(52) U.S. Cl.
CPC ..... *E04B 1/6804* (2013.01)

(58) Field of Classification Search
CPC ..... E04B 1/6804
USPC ..... 52/396.1
See application file for complete search history.

(56) References Cited

U.S. PATENT DOCUMENTS 617,881 A 1/1899 Marsh
640,409 A 1/1900 Parker
688,181 A 12/1901 Koch
1,122,076 A 12/1914 Collins
1,196,753 A 9/1916 Alms
1,537,758 A 5/1925 Fischer
1,624,121 A 4/1927 Thiem
(Continued)

FOREIGN PATENT DOCUMENTS

AU 8934730 A * 1/1991 ..... E01C 11/106
DE 2838664 A1 5/1980
(Continued)

OTHER PUBLICATIONS

Translation "Dehnungsverbindung Fuer Anschlusslinien Grosser Oberflaechen in Bauwerken" Applicant: Poggi, Leo, Mailand (Italien) DE7801755U1 (Year: 2023).*
(Continued)

*Primary Examiner* — Brian D Mattei
*Assistant Examiner* — Joseph J. Sadlon
(74) *Attorney, Agent, or Firm* — Thorpe North & Western; Jason R. Jones

(57) ABSTRACT

An expansion joint profile system for producing an expansion joint in the manufacture of a rigid floor covering includes a profile (1) comprising a first profile element (3) having a first support leg (5) provided for bearing on a substrate (18) and a first abutment leg (6) projecting upwardly therefrom. A second profile element (4) has a second abutment leg (6). A connection element (9) is formed in a ridge-like manner and extends in the longitudinal direction between the two profile elements (3, 4) and connects them to one another in the lower region. An insertion opening (10) is formed between the abutment legs and is open at the top and extends in the longitudinal direction (L). A sealing element (11) is formed in a T-shaped cross-section with a downwardly projecting insertion leg (12) for insertion into the insertion opening (10).

19 Claims, 6 Drawing Sheets

(56) References Cited

U.S. PATENT DOCUMENTS 1,913,290 A * 6/1933 Rockwell ..... E04F 15/04 114/86
1,934,266 A * 11/1933 Hession ..... E04B 1/6801 52/396.02
2,230,688 A * 2/1941 Gavotte ..... E04B 1/6803 52/287.1
2,319,345 A 5/1943 Putnam
2,332,146 A 10/1943 Holdsworth
2,391,581 A 12/1945 Markuson
2,483,888 A 10/1949 Danielson
2,843,889 A * 7/1958 Keller ..... A47B 13/083 52/287.1
2,969,616 A 1/1961 Gustafson
3,213,584 A * 10/1965 Bush ..... E04F 19/065 D25/123
3,295,268 A 1/1967 Gaither
3,307,313 A 3/1967 Tatum
3,396,640 A * 8/1968 Fujihara ..... E04B 1/6803 404/67
3,508,369 A * 4/1970 Tennison ..... E04B 1/6803 404/69
3,582,095 A * 6/1971 Bogaert ..... B32B 27/00 428/161
3,589,087 A 6/1971 De Lazzero
3,598,026 A * 8/1971 Johnson ..... E01D 19/06 404/49
3,646,716 A * 3/1972 Jenner ..... E04B 1/68 52/468
3,682,053 A * 8/1972 Kerschner ..... E01C 11/02 404/65
3,704,564 A * 12/1972 Koga ..... E04B 1/6812 52/309.4
3,797,188 A * 3/1974 Mansfeld ..... E01D 19/06 14/73.1
3,827,204 A * 8/1974 Walters ..... E04F 15/02 404/66
3,838,931 A * 10/1974 Valla ..... E01D 19/086 404/69
3,854,260 A * 12/1974 O'Hanlon ..... E04B 1/6175 52/468
3,868,802 A * 3/1975 Schubach ..... E04B 2/58 52/471
3,896,597 A * 7/1975 Deason ..... E01C 11/106 52/396.02
3,974,614 A * 8/1976 Strong ..... E04B 1/6815 14/73.1
4,050,206 A * 9/1977 Utsuyama ..... E01C 11/126 52/396.02
4,067,155 A * 1/1978 Ruff ..... E04B 1/6803 52/287.1
4,157,271 A * 6/1979 Moore ..... E04B 1/6803 52/287.1
4,346,542 A * 8/1982 Tateno ..... E01C 11/106 52/396.02
4,359,847 A * 11/1982 Schukolinski ..... E04B 1/6804 52/466
4,360,992 A * 11/1982 Marino ..... E04F 15/04 52/309.4
4,391,074 A 7/1983 Holsman
4,468,910 A * 9/1984 Morrison ..... E01C 11/225 52/177
4,564,550 A * 1/1986 Tschudin-Mahrer .... C09K 3/10 428/317.1
4,610,561 A 9/1986 Cecchellero et al.
4,651,488 A * 3/1987 Nicholas ..... E04F 13/06 52/396.02
4,793,162 A * 12/1988 Emmons ..... E02B 3/16 404/69
4,829,731 A 5/1989 Schluter
4,858,404 A 8/1989 Schluter
4,861,043 A * 8/1989 Anderson ..... E02B 3/16 404/66
4,906,129 A * 3/1990 Stegmeier ..... E04F 15/14 404/69
5,073,430 A 12/1991 Aidan
5,078,529 A * 1/1992 Moulton ..... E04B 1/6804 403/388
5,121,579 A * 6/1992 Hamar ..... E04F 15/02044 52/297
5,144,778 A 9/1992 Portau
5,148,644 A * 9/1992 Weir ..... E04B 5/12 52/301
5,181,357 A * 1/1993 Pourtau ..... E04F 19/049 52/287.1
5,203,640 A * 4/1993 Pourtau ..... E04F 15/02027 52/287.1
5,238,721 A * 8/1993 Nakazawa ..... E04F 15/02011 52/390
5,243,799 A 9/1993 Schluter
5,263,294 A * 11/1993 Koenig ..... E04F 19/062 52/471
5,289,663 A * 3/1994 Schluter ..... E04F 15/02027 52/287.1
5,333,432 A 8/1994 Schluter
5,433,986 A 7/1995 Moscatello
5,657,598 A * 8/1997 Wilbs ..... A47G 27/045 52/287.1
5,666,775 A * 9/1997 Shreiner ..... E04B 1/6803 52/573.1
5,791,111 A * 8/1998 Beenders ..... E01D 19/06 404/69
5,806,270 A * 9/1998 Solano ..... E04F 15/02 52/749.11
5,904,439 A * 5/1999 Devlin ..... E04B 1/6804 403/291
5,990,377 A * 11/1999 Chen ..... A61F 13/51305 442/79
6,047,506 A 4/2000 Kemper
6,052,960 A * 4/2000 Yonemura ..... E02D 5/14 404/69
6,141,920 A 11/2000 Kemper
6,219,982 B1 * 4/2001 Eyring ..... E04B 1/6803 52/471
6,238,773 B1 5/2001 Schluter
6,338,229 B1 1/2002 Botzen
6,357,192 B1 3/2002 Schluter
6,427,405 B1 * 8/2002 Moriya ..... E04B 1/68 52/471
6,449,911 B1 * 9/2002 Hudson ..... E04B 5/12 52/716.2
6,484,462 B2 * 11/2002 Shreiner ..... E04B 1/681 52/459
6,491,468 B1 * 12/2002 Hagen ..... E04B 1/6803 404/49
6,523,986 B1 * 2/2003 Hoffmann ..... E04F 19/02 362/374
6,591,575 B2 7/2003 Bemedettini
6,627,290 B2 * 9/2003 Wittlinger ..... D06N 7/0065 428/44
6,737,150 B2 * 5/2004 Zahler ..... A47G 27/0231 428/156
6,751,919 B2 * 6/2004 Calixto ..... E04B 1/6816 52/471
6,948,287 B2 * 9/2005 Korn ..... E04D 13/1415 52/273
7,197,855 B2 * 4/2007 Della Pepa ..... E04F 15/02194 52/312
7,389,613 B2 6/2008 Sondermann
7,827,750 B2 * 11/2010 Sondermann ..... E04B 1/681 52/396.04
7,954,298 B2 * 6/2011 Jilg ..... E04F 13/0862 52/741.12
8,024,902 B2 * 9/2011 Wedi ..... E04B 1/6803 52/459
8,132,380 B2 * 3/2012 Wilkes, Jr. ..... E04B 1/6803 404/49
8,146,313 B2 * 4/2012 Proot ..... B26B 29/06 52/716.2

(56) References Cited

U.S. PATENT DOCUMENTS 8,161,708 B2 * 4/2012 Schacht ..... E04F 15/02005 52/312
8,551,594 B2 * 10/2013 Deiss ..... E04B 1/6812 428/40.1
8,716,624 B2 5/2014 Johnson
8,769,883 B2 * 7/2014 Bazzarini ..... E04B 1/681 362/153.1
8,820,002 B2 * 9/2014 Hunt ..... E04F 19/00 52/27
8,959,860 B2 * 2/2015 Wierzbowski ..... E04B 1/681 52/461
8,959,872 B2 * 2/2015 Ayres ..... E04F 15/02435 52/396.04
8,978,334 B2 * 3/2015 Engstrom ..... E04F 15/02 52/391
9,290,949 B2 * 3/2016 Choy ..... E04F 15/08
9,321,493 B2 4/2016 Dost et al.
9,359,761 B2 * 6/2016 Scurto ..... E04B 1/6812
9,482,010 B2 11/2016 Wambaug
9,494,235 B2 * 11/2016 Winslow ..... B29D 99/0053
9,597,832 B2 * 3/2017 Deiss ..... B29C 53/04
9,636,892 B2 * 5/2017 Albert ..... B32B 27/20
9,783,999 B2 * 10/2017 Amundson ..... B29C 48/12
9,850,668 B2 * 12/2017 Della Pepa ..... B32B 13/02
9,908,965 B2 * 3/2018 Sauttreau ..... C08G 18/10
9,956,723 B2 * 5/2018 Kodera ..... B29C 65/48
10,100,514 B2 * 10/2018 Klein ..... E04B 2/7411
10,202,777 B1 * 2/2019 Leavey ..... E04F 19/0481
10,450,762 B2 10/2019 Schluter
10,487,518 B2 * 11/2019 Anzalone, Jr. ..... E04F 19/061
10,563,360 B2 * 2/2020 Bang ..... E01D 19/06
10,683,660 B2 * 6/2020 Preston ..... E04B 1/6801
10,723,110 B2 * 7/2020 Ober ..... B32B 37/06
10,760,283 B2 * 9/2020 Carrubba ..... E04F 15/02033
10,851,541 B2 * 12/2020 Robinson ..... E04B 1/6812
10,935,138 B2 * 3/2021 Fina Segura ..... E04B 1/681
11,091,908 B2 * 8/2021 Paetow ..... E04B 1/948
11,103,109 B2 8/2021 Schluter
11,180,915 B2 * 11/2021 Richardson ..... E04B 9/0457
11,384,545 B2 7/2022 Schluter
11,781,043 B2 * 10/2023 Ackermann ..... C09J 7/385 277/654
11,785,727 B2 10/2023 Lowen
2002/0189190 A1 * 12/2002 Charmat ..... E04C 2/22 52/586.2
2003/0051426 A1 * 3/2003 Kornfalt ..... E04F 15/04 52/461
2003/0074851 A1 * 4/2003 Charmat ..... E04F 13/0871 52/393
2003/0154662 A1 * 8/2003 Bruchu ..... E04F 15/02194 52/87
2004/0106346 A1 * 6/2004 Zafiroglu ..... B32B 3/28 442/149
2005/0039409 A1 2/2005 Sondermann
2005/0158354 A1 * 7/2005 Hannay ..... A01N 25/34 424/410
2008/0034691 A1 * 2/2008 Nelson ..... B32B 15/20 52/395
2008/0078135 A1 * 4/2008 McIntosh ..... E04B 1/6175 52/468
2008/0083179 A1 4/2008 Riggs
2008/0086808 A1 * 4/2008 Sutton ..... D03D 15/47 28/143
2008/0110126 A1 5/2008 Howchin
2008/0229682 A1 * 9/2008 Torsani ..... E04B 1/681 403/220
2008/0263983 A1 * 10/2008 Stanchfield ..... E04F 11/166 52/459
2009/0178369 A1 7/2009 Pilz
2009/0205278 A1 * 8/2009 Lynch ..... E01D 2/00 428/221
2010/0287872 A1 11/2010 Bodnar
2013/0000187 A1 1/2013 Raisacher
2014/0057066 A1 * 2/2014 Cai ..... E04C 2/26 428/80
2015/0240503 A1 * 8/2015 Scurto ..... E04B 5/32 404/69
2017/0071415 A1 3/2017 Rosko
2017/0362819 A1 * 12/2017 Sondermann ..... E04B 1/6804
2018/0251265 A1 9/2018 Egertz et al.
2018/0334813 A1 * 11/2018 Schluter ..... E04F 19/061
2019/0077124 A1 * 3/2019 Shinbara ..... B32B 7/12
2019/0225849 A1 * 7/2019 Bollström ..... C09K 3/149
2022/0010548 A1 1/2022 Schluter

FOREIGN PATENT DOCUMENTS

DE 8502738 U1 1/1985
DE 3405571 A1 8/1985
DE 3407075 A * 9/1985 ..... E01D 19/06
DE 3429860 A * 3/1986 ..... E01D 19/06
DE 3929187 A * 3/1991 ..... E01C 11/126
DE 4141138 A1 * 6/1993 ..... E04B 1/6804
DE 4406890 A1 9/1995
DE 29809789 U1 9/1998
DE 19800554 A1 * 7/1999 ..... E04F 15/02005
DE 10140464 A1 * 2/2003 ..... E04B 1/6812
DE 202006019436 U1 3/2007
DE 102007002639 A1 7/2008
DE 202009002336 U1 7/2010
DE 102009050698 A1 * 4/2011 ..... E04B 1/681
EP 0627534 A2 12/1994
EP 1152100 A1 * 11/2001 ..... E04B 1/6804
EP 1918486 A2 5/2008
EP 3404168 B1 8/2019
FR 2576942 A1 * 8/1986 ..... E04B 1/6815
GB 191417164 A * 12/1914 ..... E01C 5/14
GB 2452378 3/2009
GB 2560741 A * 9/2018 ..... E01C 11/04
JP H05321916 A 12/1993
JP 2003269423 A 9/2003
JP 2014177809 A 9/2014
WO WO 9000684 A1 1/1990
WO WO-9201843 A * 2/1992 ..... E04B 1/6804
WO WO 98/54423 A1 12/1998
WO WO-2006114458 A1 * 11/2006 ..... E04F 13/08

OTHER PUBLICATIONS

Description DE7801755U1, Applicant(s): Poggi, Leo, Mailand, May 11, 1978 retrieved from https://worldwide.espacenet.com/publicationDetails/biblio?DB=EPODOC&II=0&ND=3&adjacent=true&locale=en_EP&FT=D&date=19780511&CC=DE&NR=7801755U1&KC=U1 (Year: 2023).*
Floor Profiles, Schluter Systems; Profile of Innovation, Apr. 2019, 9 Pages, New York, USA.
Movement Joints and Cove-Shaped Profiles, Schluter Systems; Profile of Innovation, Sep. 2019, 19 Pages, New York, USA.
Wall and Countertop Profiles, Schluter Systems; Profile of Innovation, Nov. 2019, 20 Pages, New York, USA.

* cited by examiner

EXPANSION JOINT PROFILE SYSTEM

PRIORITY CLAIM

Priority is claimed of and to German Patent Application Serial No. 20 2020 103 699.8, filed Jun. 26, 2020, which is hereby incorporated herein by reference in its entirety.

BACKGROUND OF THE INVENTION

Field of the Invention

The present invention relates to expansion joint profile systems for producing an expansion joint in the manufacture of a rigid floor covering.

SUMMARY OF THE INVENTION

In accordance with one aspect of the technology, an expansion joint profile system for producing an expansion joint in the manufacture of a rigid floor covering is provided, including a profile (1) having a first profile element (3) made of a first material and having an L-shaped cross-section, extending in a longitudinal direction (L) and having a first support leg (5) provided for bearing on a substrate (18). A first abutment leg (6) can be connected to one of the longitudinal edges of the support leg (5) and can project upwardly therefrom. A second profile element (4) can be made of said first material and can have a second abutment leg (6) which is formed to correspond to the first abutment leg (6) and extends in particular parallel to the first abutment leg (6). A connection element (9) can be made of a second material having a higher elasticity than the first material. The connection element (9) can be formed in a ridge-like manner, and can extend in the longitudinal direction between the two profile elements (3, 4), connecting them to one another in the lower region and, together with the two abutment legs (6), forms an insertion opening (10) which is open at the top and extends in the longitudinal direction (L). A sealing element (11) can be made of a third material having a higher elasticity than said first material. The sealing element (11) can extend in the longitudinal direction (L), and can be formed in a T-shaped cross-section with a downwardly projecting insertion leg (12) designed for insertion into the insertion opening (10). The sealing element can include two laterally projecting compression legs (13), wherein the compression legs (13), when the insertion leg (12) is disposed in the insertion opening (10), project outwardly from the abutment legs (6), respectively, wherein the third material may correspond to the second material.

In accordance with another aspect of the technology, an expansion joint profile system for producing an expansion joint in the manufacture of a rigid floor covering can be provided, including a profile (1) having a first profile element (3) having an L-shaped cross-section, extending in a longitudinal direction (L) and having a first support leg (5) provided for bearing on a substrate (18) and a first abutment leg (6) connected to one of the longitudinal edges of the support leg (5) and projecting upwardly therefrom. A second profile element (4) can have a second abutment leg (6) which is formed to correspond to the first abutment leg (6) and extends in particular parallel to the first abutment leg (6). An elastic connection element (9) can be formed in a ridge-like manner, extending in the longitudinal direction between the two profile elements (3, 4), connecting them to one another in the lower region, and an insertion opening (10) formed between the abutment legs which is open at the top and extends in the longitudinal direction (L). A sealing element (11) can be made of an elastic material extending in the longitudinal direction (L), formed in a T-shaped cross-section with a downwardly projecting insertion leg (12) designed for insertion into the insertion opening (10).

BRIEF DESCRIPTION OF THE DRAWINGS

The same reference numbers relate hereafter to identical or similar components or component ranges.

DETAILED DESCRIPTION

Figure 1:
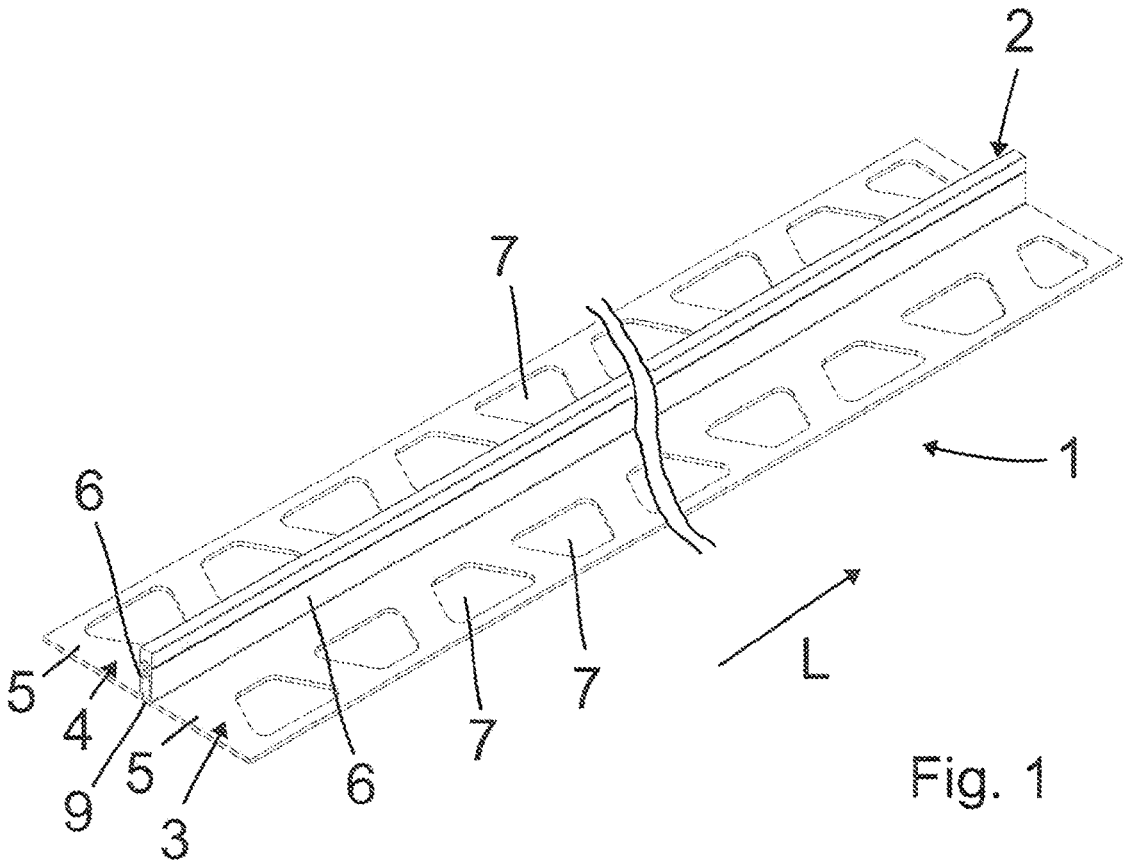
FIG. 1 is a perspective view of a profile with a cover element arranged thereon, wherein the profile and the cover element form components of an expansion joint profile system according to an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a profile" can include one or more of such pieces, if the context dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure. Generally, directional terms used in this application, such as "top" or "bottom" refer to the installed state. The formulations "substantially vertical" and "substantially horizontal" are to be construed such that the main extension direction is vertical and horizontal, respectively.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

Expansion joint profiles are known in the prior art in a wide variety of configurations. They are positioned above an existing expansion joint in the underground (or subfloor or substrate) during the manufacture of a rigid floor covering made of tiles or natural stones and fastened to the underground (substrate), whereupon the floor covering tiles are laid on both sides of the expansion joint profile.

Commercially available expansion joint profiles often have two L-shaped profiles made of metal or plastic, each defining a support leg and an abutment leg projecting upwards from this support leg, usually arranged perpendicular to it. The two L-shaped profiles are arranged parallel to each other at a predetermined distance in such a way that the support legs are aligned with each other, while the abutment legs face each other. A free space serving as a movement zone is provided between the support legs, which is partially bridged by an elastic and soft material connecting the two support legs, which may be a silicone material, for example. The support legs are each provided with a plurality of through-holes spaced apart from one another in the longitudinal direction, which serve to fix the support legs to the substrate.

When installing such an expansion joint profile, the support legs are fixed to the underground (substrate), typically using a thin-bed mortar that embeds the support legs and penetrates the through-holes. The floor covering panels are then laid in such a way that they cover the support legs and face the abutment legs of the expansion joint profile. An expansion joint profile of the type described above is sold, for example, by Schlüter Systems KG under the product name "Schlüter®-Dilex-BWB".

One disadvantage of an expansion joint profile with such a structure is that the expansion joint generated with it in the installed state appears visually quite wide compared to the other joints present between the individual tile or natural stone slabs. This is due to the fact that the width of the cementitious joints between the expansion joint profile and the adjacent tile or natural stone slabs is added to the actual width of the expansion joint profile.

Based on this prior art, one task of the present invention is to create an expansion joint profile system with an improved structure.

To solve this problem, the present invention provides an expansion joint profile system for producing an expansion joint in the manufacture of a rigid floor covering, including, in one embodiment:

a profile comprising a first profile element made of a first material and having an L-shaped cross-section, extending in a longitudinal direction and having a first support leg provided for bearing on an underground (or substrate) and a first abutment leg connected to one of the longitudinal edges of the support leg and projecting upwardly therefrom, a second profile element made of said first material and having a second abutment leg which is formed to correspond to the first abutment leg and extends in particular parallel to the first abutment leg, and a connection element which is made of a second material having a higher elasticity than the first material, wherein the connection element is formed in a ridge-like manner, extends in the longitudinal direction between the two profile elements, connects them to one another in the lower region and, together with the two abutment legs, forms an insertion opening which is open at the top and extends in the longitudinal direction, and a sealing element made of a third material having a higher elasticity than said first material, wherein the sealing element extends in the longitudinal direction, is formed in a T-shaped cross-section with a downwardly projecting insertion leg designed for insertion into the insertion opening and with two laterally projecting compression legs, wherein the compression legs, when the insertion leg is disposed in the insertion opening, project outwardly from the abutment legs, respectively, wherein the third material may correspond to the second material.

In the manufacture of a rigid floor covering of tile or natural stone slabs on an underground (or subfloor or substrate) provided with an expansion joint, the profile of the expansion joint profile system according to the invention is positioned in a first step in such a way that the elastic connecting element extends above along the expansion joint, whereupon the at least one support leg is fixed to the substrate, using, in one embodiment, a thin-bed mortar or tile adhesive. In a further step, additional thin-bed mortar can be applied to the upper sides of the at least one support leg of the expansion joint profile. The tile or natural stone slabs are then laid in the thin-bed mortar in such a way that the end faces of the tile or natural stone slabs come into direct contact with the support legs. The height of the profile is selected according to the height of the tile or natural stone slabs. After the thin-bed mortar has dried, the joints or gaps between the tiles or natural stone slabs are grouted with a suitable grout. In a final step, the insertion leg of the sealing element is pressed into the insertion opening from above until the compression legs rest with pressure against the end faces of the adjacent tile or natural stone slabs. In this way, any gaps between the tile or natural stone slabs and the abutment legs are also covered, which is why it is not necessary to provide a mortar joint between the tile or natural stone slabs and the abutment legs of the expansion joint profile according to the invention. This results in the expansion joint appearing visually not very wide.

In one embodiment, the first material is a plastic, in particular a hard-set plastic.

The second material and/or the third material can advantageously be a softly adjusted silicone or plastic material, which in particular is designed to be resistant to fungi and bacteria.

According to one embodiment of the present invention, the second profile element is L-shaped in cross-section and has a second support leg which is provided for bearing on an underground and is connected to the lower longitudinal edge of the second support leg. A second support leg gives the expansion joint profile better stability in the installed state.

In one embodiment, the first support leg and, if present, the second support leg is/are provided with a plurality of through openings distributed along the longitudinal direction. Such through-holes serve to anchor the support legs in an adhesive or thin-bed mortar when they are installed.

Advantageously, the first support leg and, if present, the second support leg can each have a height (h) in the range from 0.5 to 2 mm, in particular in the range from 0.8 to 1.2 mm. This ensures that the expansion joint profile can be embedded well in the thin-bed mortar between the underground and the floor covering when a rigid floor covering is laid using the thin-bed method.

The first support leg and, if present, the second support leg can each have a width in the range from 8 to 30 mm. With such a width, a secure fastening of the expansion joint profile to the substrate can be ensured.

According to one embodiment of the present invention, the abutment legs each extend perpendicularly to the support leg or legs.

Advantageously, the abutment legs can be provided, at least in the upper region, with inwardly directed, longitudinally extending locking ribs, in order to give the sealing element a good hold when it is positioned with its insertion leg in the insertion opening.

The abutment legs can, in one embodiment, have a constant cross section in the longitudinal direction, which simplifies the manufacture of the expansion joint profile.

The abutment legs (6) can advantageously have a height (H) in the range from 4 to 30 mm.

The abutment legs can have a width in the range from 0.5 to 2 mm, in particular in the range from 0.8 to 1.2 mm.

According to one embodiment of the present invention, the first profile element and the second profile element are each an extruded profile, the extruded profiles being in particular of the same cross-sectional shape.

The insertion leg can be provided with outwardly projecting locking projections which can be designed in particular to cooperate with the above-mentioned locking ribs.

The compression legs can advantageously be provided with lateral recesses extending in the longitudinal direction, which improves the deformability of the compression legs.

According to one embodiment of the present invention, a cover element can be provided which extends in the longitudinal direction, the width of which corresponds to the distance between the outer surfaces of the abutment legs and which can be detachably placed on the abutment legs or is connected to at least one of the abutment legs in the delivery state of the expansion joint profile, the connection being designed in the manner of a predetermined breaking point in order to separate the cover element from the abutment leg or legs. In the latter case, the cover element may also be connected to both abutment legs, with both connections being designed in a predetermined breaking point-like manner. In this case, the two profile elements and the cover element can also be manufactured in one piece. The provision of a cover element prevents the grout from entering the insertion opening of the expansion joint profile when filling the joints between the tile or natural stone slabs.

In one embodiment, the cover element is made of a fourth material, which is in particular a plastic.

Further features and advantages of the present invention will become apparent from the following description of systems according to embodiments of the present invention with reference to the accompanying drawing. Hereinafter, same reference numbers refer to same or similar components or component areas.

FIGS. 1 to 8 show the individual components of an expansion joint profile system according to one embodiment of the present invention, which is used to create an expansion joint in the manufacture of a rigid floor covering.

FIG. 1 shows a profile 1 with a cover element 2 attached thereto. The profile 1, which is also shown in a stand-alone position in FIGS. 3 and 4, comprises a first profile element 3 and a second profile element 4, which are of identical design in the present case, which is why functionally identical component regions are designated below with the same reference numerals for the sake of simplicity. The profile elements 3 and 4 can be manufactured from a first material as extruded profiles, which is, in one embodiment a hard plastic, although in principle other materials can also be used, such as metal or a metal alloy. The profile elements 3 and 4, which extend in the longitudinal direction L, each have an L-shaped cross-section which is formed by a support leg provided for support on an underground and by an abutment leg 6 projecting perpendicularly upwards from the support leg 5 in the present case. In the example shown, the support legs 5 and the abutment legs 6 each have a rectangular shape. The support legs in one embodiment have a height "h" in the range from 0.5 to 2 mm, in particular in the range from 0.8 to 1.2 mm, and a width "b" in the range from 8 to 30 mm. They are each provided with a plurality of through openings 7 distributed along the longitudinal direction L. The abutment legs 6 have a height "H" in the range from 4 to 30 mm and a width "B" in the range from 0.5 to 2 mm, in particular in the range from 0.8 to 1.2 mm. In the upper region, the abutment legs 6 are provided with inwardly pointing locking ribs 8 extending in the longitudinal direction L.

Figure 3:
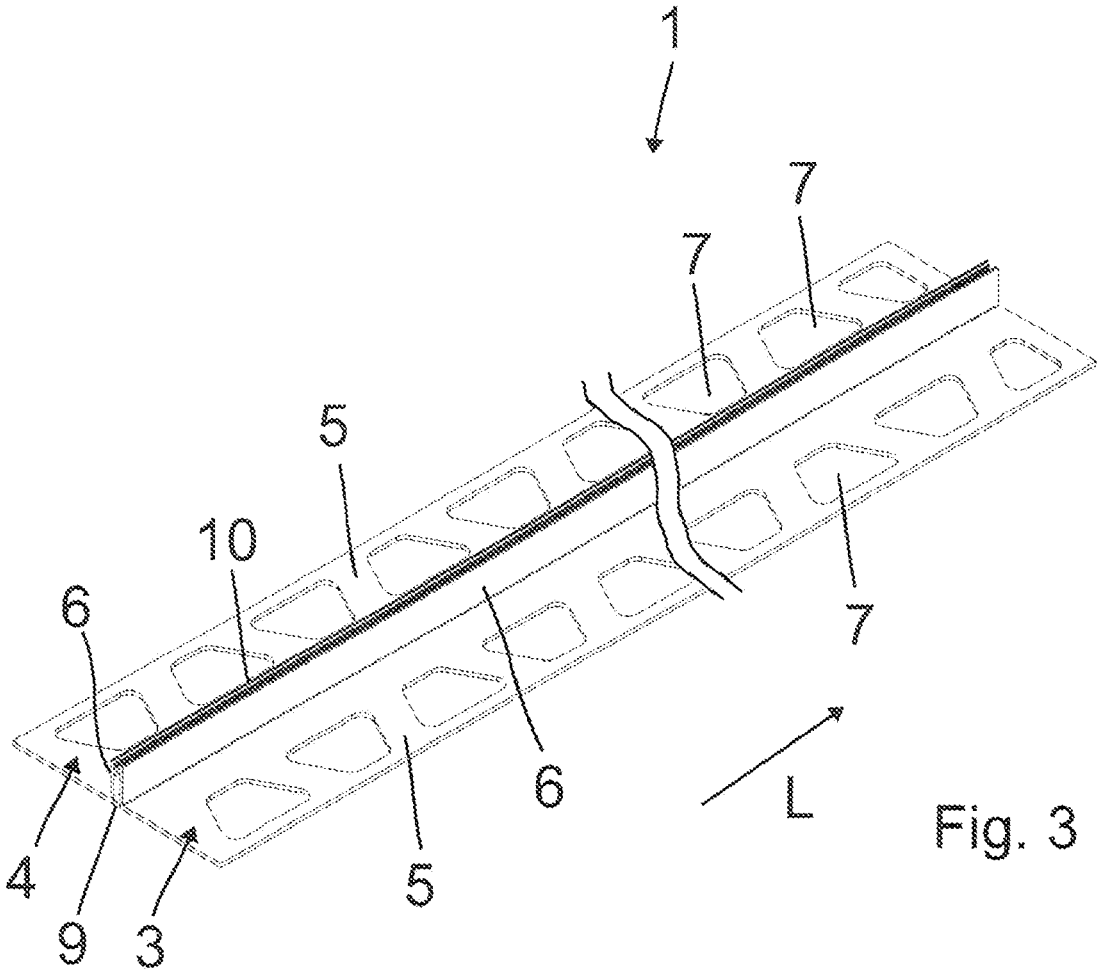
FIG. 3 is a perspective view of the profile of FIG. 1 after removal of the cover element.
Figure 4:
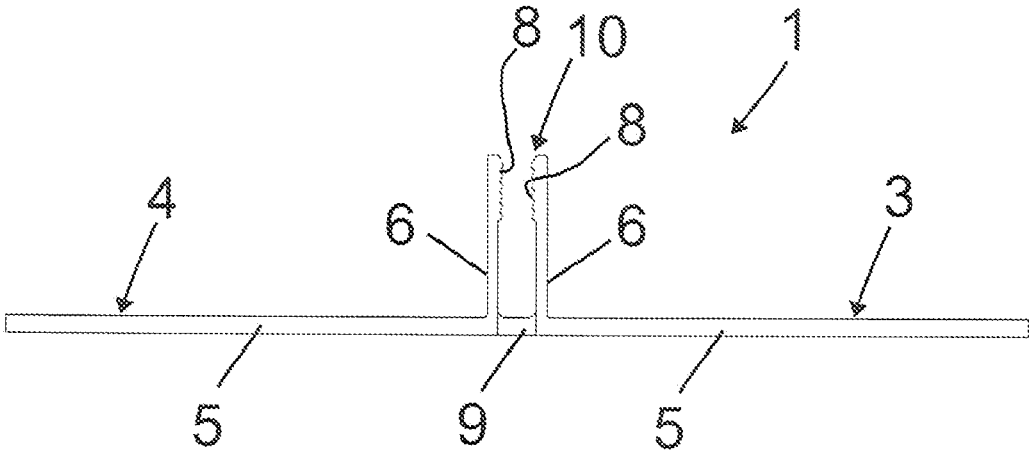
FIG. 4 is an enlarged front view of the profile shown in FIG. 3.

In addition to the profile elements 3 and 4, the profile 1 can also include a connecting element 9, which is of ridge-like design, extends in the longitudinal direction L between the two profile elements 3 and 4 and connects them to one another in the lower region in such a way that an upwardly open insertion opening 10 is formed above the connecting element 9, which opening is bounded at the bottom by the connecting element 9 and laterally by the inner sides of the abutment legs 6 of the two profile elements 3 and 4, see in particular FIGS. 3 and 4. The connecting element 9 is made of a second material which has a higher elasticity than the first material from which the two profile elements 3 and 4 are made. The second material can be a softly adjusted silicone or plastic material, which in particular is designed to be resistant to fungi and bacteria.

The cover element 2 is arranged above the two profile elements 3 and 4 and is presently connected to the two abutment legs 6, the connections between the cover element 2 and the abutment legs 6 being designed in the manner of predetermined breaking points so that they can be easily separated manually or with a tool. In the embodiment shown, the profile elements 3 and 4 and the cover element 2 are designed as a single extruded profile. To form the predetermined breaking point, the material thickness in the transition area between the abutment legs 6 of the profile elements 3 and 4 and the cover element 2 is very thin. In principle, however, the cover element 2 could also be provided as a separate component. The width "b1" of the cover element 2 can correspond to the distance between the outer surfaces of the abutment legs 6, so that the cover element 2 does not project laterally from the abutment legs 6. The cover element 2 is can be made of a plastic material. The plastic material can correspond to that of the two profile elements 3 and 4. Alternatively, however, it may also be a different plastic material, such as a soft-set silicone or plastic material.

Figure 2:
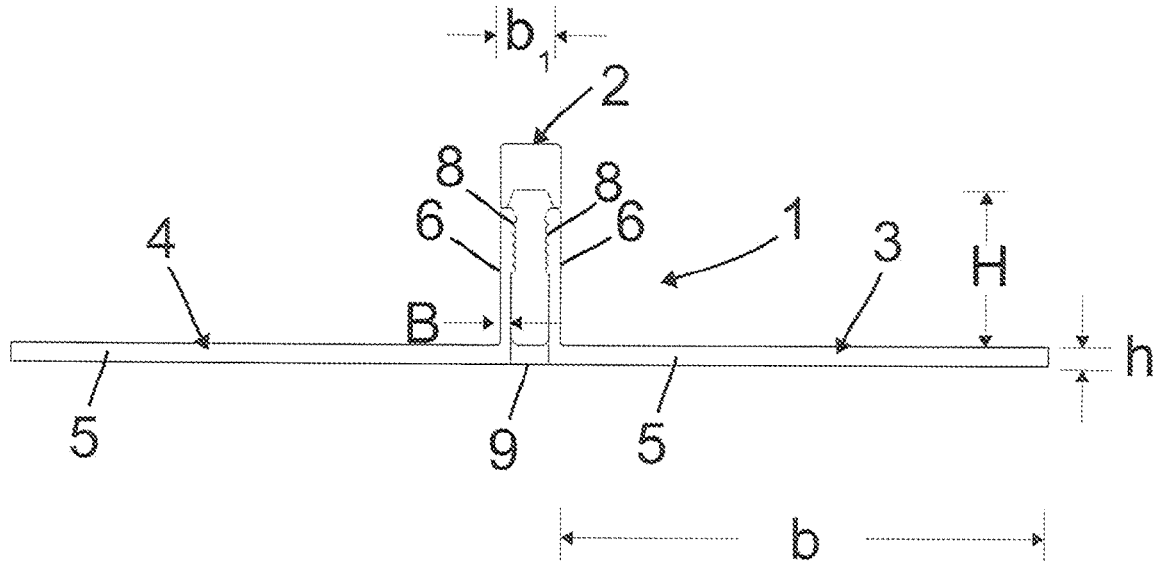
FIG. 2 is an enlarged, front view of the arrangement shown in FIG. 1.

FIGS. 3 and 4 show the arrangement shown in FIGS. 1 and 2 after removal of the cover element 2. In this state, the insertion opening 10 is exposed and accessible from the outside.

Figure 5:
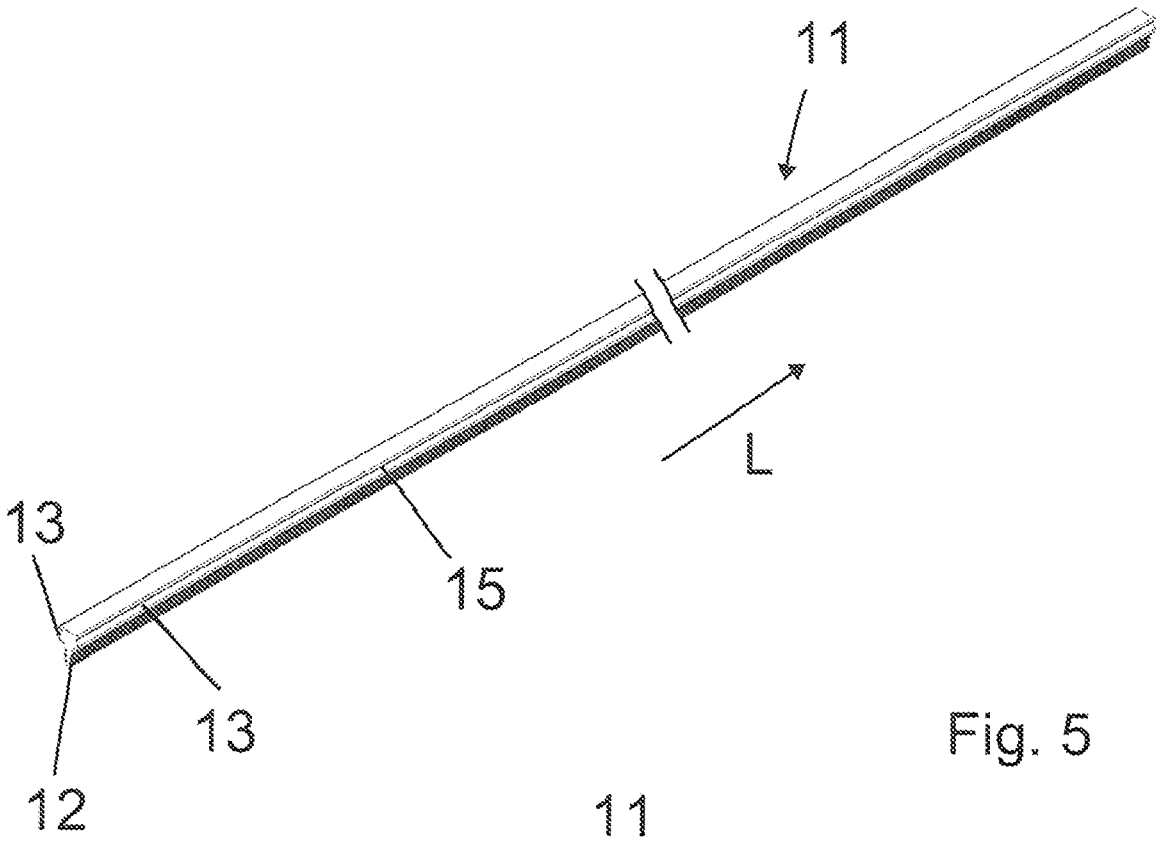
FIG. 5 is a perspective view of a sealing element of the expansion joint profile system.
Figure 6:
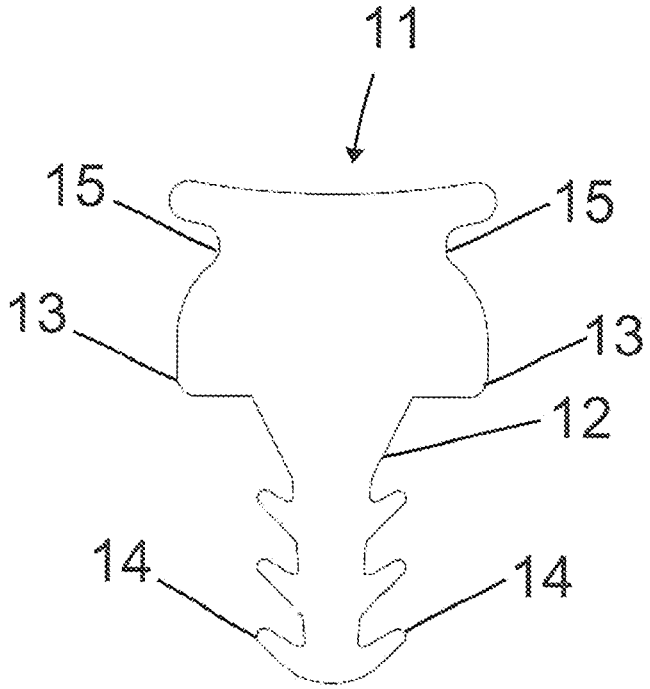
FIG. 6 is an enlarged front view of the sealing element shown in FIG. 5.
Figure 7:
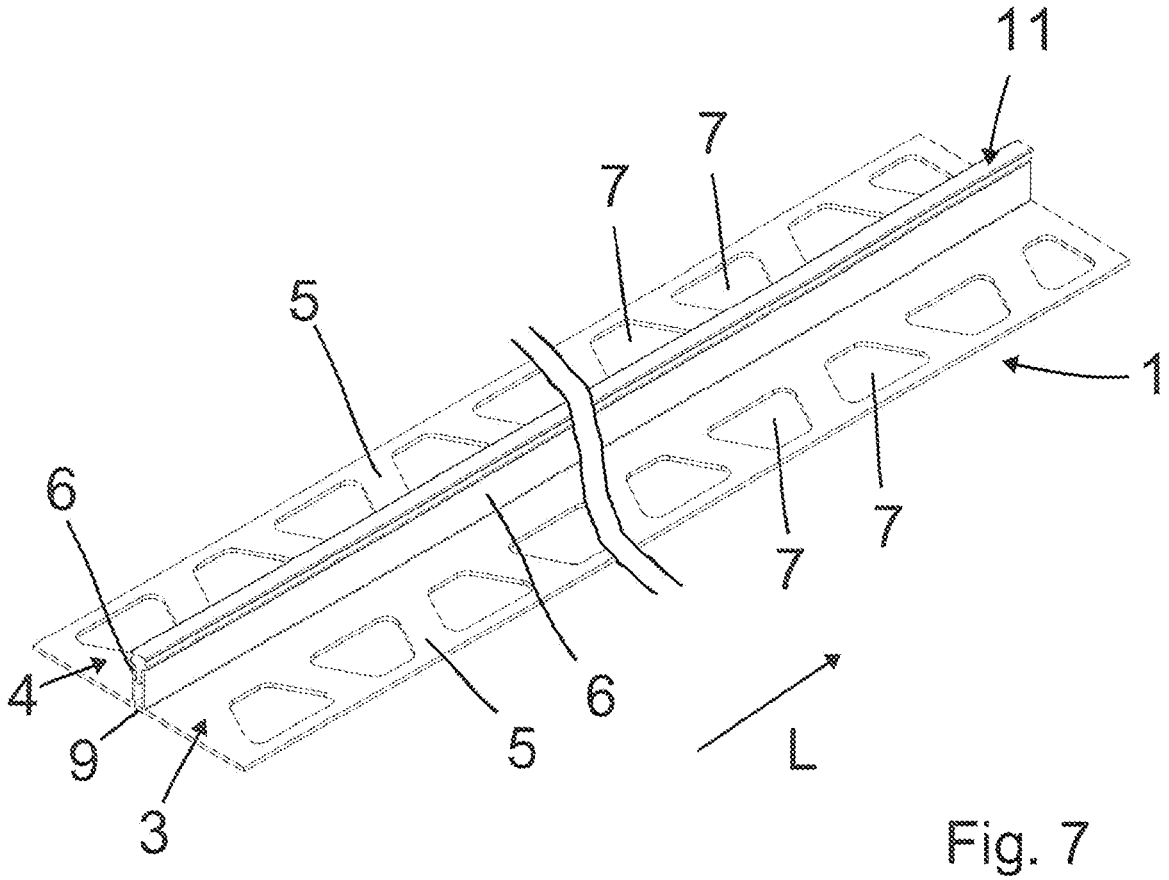
FIG. 7 is a perspective view of the profile shown in FIGS. 3 and 4 to which the sealing element shown in FIGS. 5 and 6 is attached.
Figure 8:
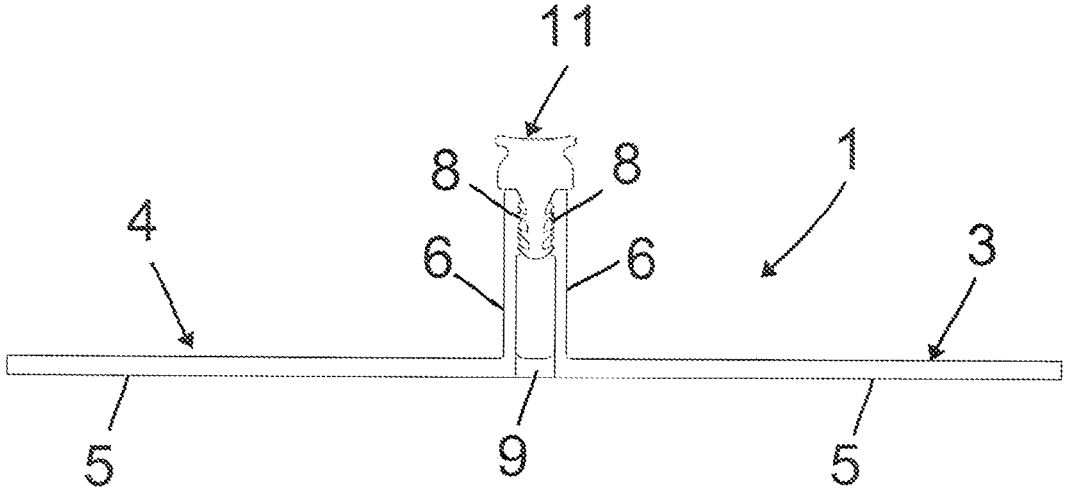
FIG. 8 is an enlarged front view of the assembly shown in FIG. 7.

FIGS. 5 and 6 show a sealing element 11 of the expansion profile system. The sealing element 11, which extends in the longitudinal direction L, is T-shaped in cross-section and has a downwardly projecting insertion leg 12, which is designed for insertion into the insertion opening 10, and two laterally projecting compression legs 13. The insertion leg 12 is provided with outwardly projecting locking projections 14, which are designed to cooperate with the locking ribs 8 of the abutment legs 6 of the profile elements 3 and 4 when the insertion leg 12 of the sealing element 11 is inserted into the insertion opening 10 of the profile 1. The dimensions of the compression legs 13 are chosen in such a way that, when the insertion leg 12 is arranged in the insertion opening 10, the compression legs 13 each project outwardly to the side from the abutment legs 6 of the profile elements 3 and 4, as shown in FIGS. 7 and 8. Laterally, the compression legs 13 are provided with recesses 15 extending in the longitudinal direction L. FIGS. 7 and 8 show the profile 1 with sealing element 11 received therein.

The length of the profile 1, the cover element 2 and the sealing element 11 can be selected uniformly and be, for example, 2000 mm or more. However, the sealing element 11 can also be provided as rolled material with a length of 2000 mm or more, so that this is cut to size on site.

Figure 9:
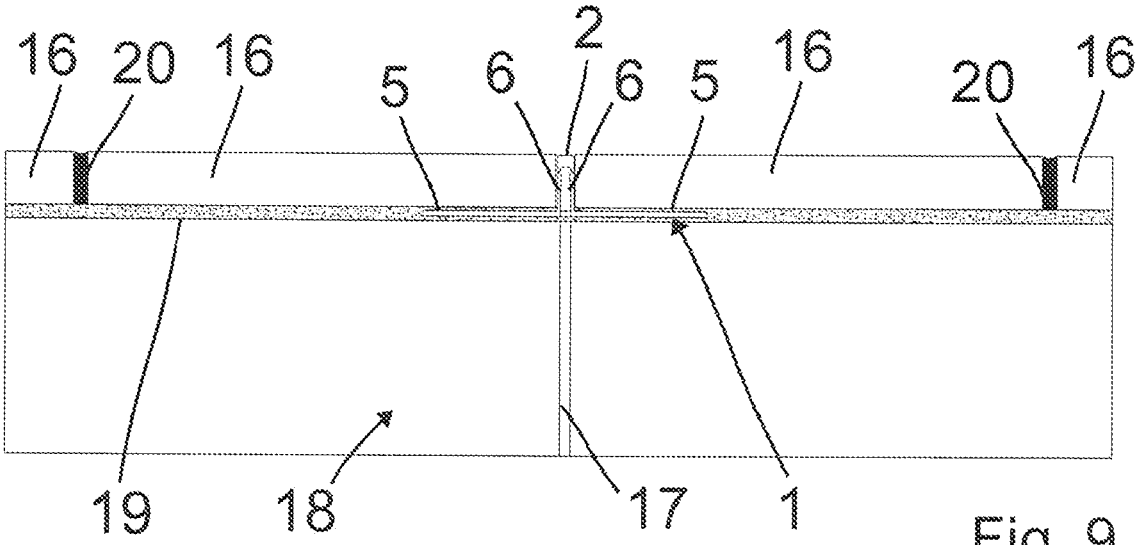
FIG. 9 is a sectional view showing a flooring assembly during the manufacture of a rigid flooring using the expansion joint profile system after a first installation step has been performed.

In the production of a rigid floor covering of tile or natural stone slabs 16 on an underground or substrate 18 provided with an expansion joint 17, in a first installation step the arrangement shown in FIGS. 1 and 2, i.e. the profile 1 with cover element 2 held thereon, is positioned and fastened above the expansion joint 17 in such a way that the connecting element 9 extends above and along the expansion joint 17. For this purpose, a thin-bed mortar 19 is applied with a toothed (or notched) trowel to the surface of the underground or substrate 18, leaving a gap in the expansion joint 17, whereupon the support legs 5 of the profile elements 3 and 4 are pressed into the thin-bed mortar 19. In the process, the support legs 5 are embedded in the thin-bed mortar 19, which penetrates the through openings 7 formed in the support legs 5. In addition, the thin-bed mortar 19 can be applied to the upper sides of the support legs of the profile 1. The tile or natural stone slabs 16 are then laid in the thin-bed mortar 19 on the end faces adjacent to the respective abutment legs 6 of the profile elements 3 and 4 in such a way that the end faces of the tile or natural stone slabs 16 come into contact with the abutment legs 6. After the thin-bed mortar 19 has hardened, the joints between adjacent tile or natural stone slabs 16 are filled with a grout 20. This does not apply to any gaps that may exist between the tile or natural stone slabs 16 and the abutment legs 6. The arrangement now obtained is shown in FIG. 9. The cover element 2 prevents thin-bed mortar 19 or grout 20 from inadvertently penetrating the insertion opening 10 of the profile 1 while the first installation step is being carried out.

Figure 10:
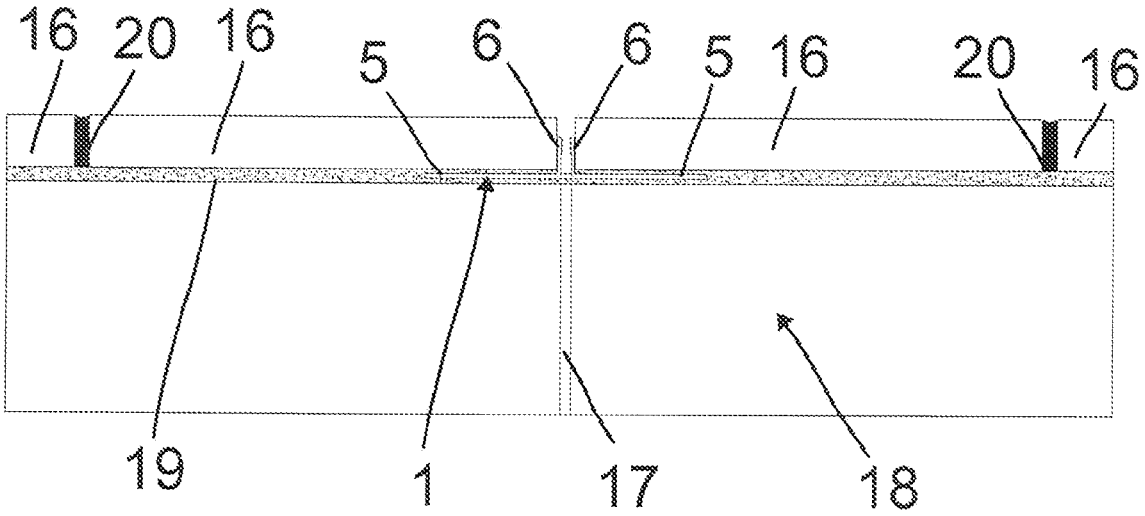
FIG. 10 is a sectional view of the flooring assembly of FIG. 9 after performing a second installation step.

In a further installation step, the cover element 2 is removed from the profile 1, either manually or with the aid of a tool. The separation between the cover element 2 and the profile 1 is facilitated by the formation of the connection as a predetermined breaking point. The arrangement now achieved is shown in FIG. 10.

In a final installation step, the sealing element 11 is now pressed from above into the insertion opening 10 of the profile 1. Here, the locking projections 14 of the insertion leg 12 of the sealing element 11 come into locking engagement with the locking ribs 8 formed on the abutment legs 6 of the profile elements 3 and 4. During this process, the compression legs 13 press against the end faces of the tile or natural stone slabs 16 projecting upwards beyond the abutment legs 6.

Figure 11:
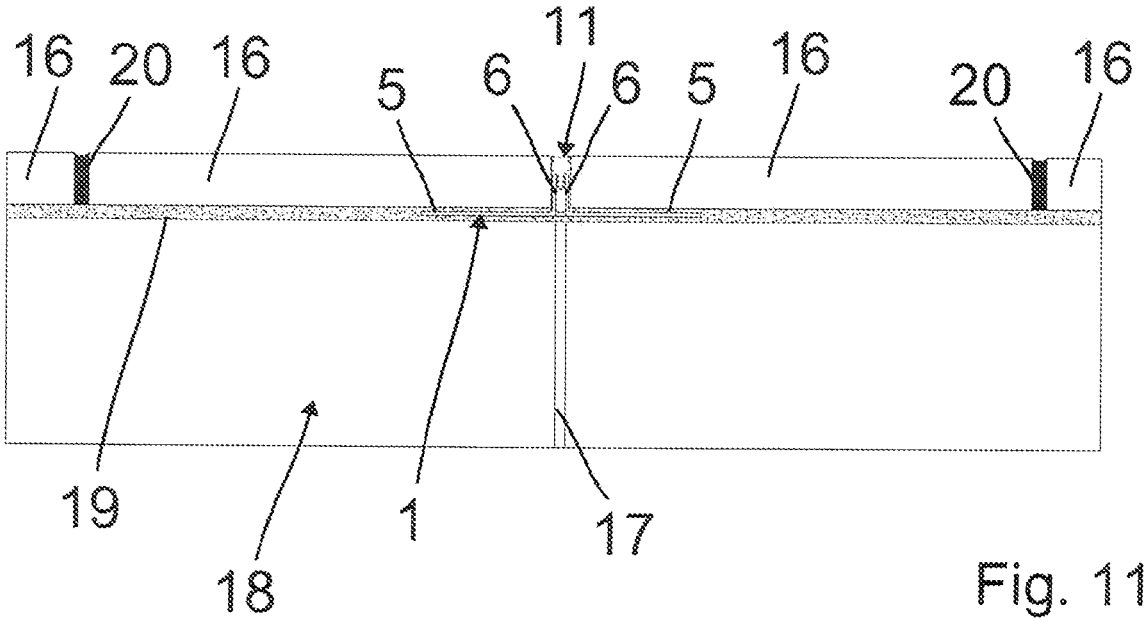
FIG. 11 a sectional view of the flooring assembly of FIG. 9 after performing a third installation step.

A significant advantage of the arrangement shown in FIG. 11 is that no joint needs to be provided between the abutment legs 6 of the profile elements 3 and 4 and the tile or natural stone slabs 16, since the compression legs 13 of the sealing element 11, which bear directly against the tile or natural stone slabs 16, cover any gaps or joints that may exist. As a result, the expansion joint produced by the expansion joint profile system according to the invention is indistinguishable in terms of width from the joints existing between adjacent tile or natural stone slabs 16.

It should be clear that the previously described embodiment serves merely as an example and is not to be understood as restrictive. Rather, modifications are possible without departing from the scope of protection defined by the appended claims. For example, the cover element 2 can be dispensed with completely. Likewise, the second profile element 4 can have exclusively an abutment leg 6, i.e. no support leg 5, whereby the profile 1 as a whole is given an F-shape in cross-section.

It will be recognized that embodiments of profile systems in accordance with the invention are not limited to the above-described embodiments, and various modifications may be possible without departing from the scope of the invention as defined in the appended claims.

REFERENCE NUMBERS

1 Profile
2 cover element

3 first profile element
4 second profile element
5 support leg
6 abutment leg
7 passage opening
8 locking rib
9 connecting element
10 insertion opening
11 sealing element
12 insertion leg
13 compression leg
14 locking projection
15 recess
16 tile or natural stone slab
17 expansion joint
18 underground (or substrate)
19 thin bed mortar
20 grout

The invention claimed is:

1. A floor covering, comprising:

a profile (1) comprising a first profile element (3) made of a first material and having an L-shaped cross-section, extending in a longitudinal direction (L) and having a first support leg (5) provided for bearing on a substrate (18) and a first abutment leg (6) connected to one of the longitudinal edges of the support leg (5) and projecting upwardly therefrom, a second profile element (4) made of said first material and having a second abutment leg (6) which is formed to correspond to the first abutment leg (6) and extends parallel to the first abutment leg (6), and a connection element (9) which is made of a second material having a higher elasticity than the first material, the second material being a soft-set silicone or elastic material, which is resistant to fungi and bacteria, wherein the connection element (9) is formed in a ridge-like manner, extends in the longitudinal direction between the two profile elements (3, 4), connects them to one another in the lower region allowing them to move elastically relative to one another and, together with the two abutment legs (6), forms an insertion opening (10) which is open at the top and extends in the longitudinal direction (L), at least two tiles or stone slabs (16), one each of which is installed atop a support leg (5) with a portion of end faces of the tiles or stone slabs (16) in contact with the abutment legs (6) and another portion of end faces of the tiles or stone slabs extending above the abutment legs (6); and a sealing element (11) made of a third material having a higher elasticity than said first material, wherein the sealing element (11) extends in the longitudinal direction (L), is formed in a T-shaped cross-section with a downwardly projecting insertion leg (12) designed for insertion into the insertion opening (10) and with two laterally projecting compression legs (13), wherein the compression legs (13), when the insertion leg (12) is disposed in the insertion opening (10), project outwardly above the abutment legs (6), respectively, the compression legs pressing against the portion of the end faces of the tile or stone slabs (16) extending above the abutment legs (6).

2. The floor covering according to claim 1, wherein the first material is plastic.

3. The floor covering according to claim 1, wherein the second profile element (4) is L-shaped in cross-section and has a second support leg (5) which is provided for bearing on the substrate (18) and is connected to the lower longitudinal edge of the second support leg (6).

4. The floor covering according to claim 3, wherein the first support leg (5) and the second support leg (5) are provided with a plurality of through openings (7) distributed along the longitudinal direction (L), the through openings (7) being covered by the tile or stone slabs (16) installed atop the support legs (5).

5. The floor covering according to claim 3, wherein the first support leg (5) and the second support leg (5) each have a height (h) in the range from 0.5 to 2 mm.

6. The floor covering according to claim 5, wherein the first support leg (5) and the second support leg (5) each have a width (b) in the range from 8 to 30 mm.

7. The floor covering according to claim 1, wherein the abutment legs (6) each extend perpendicularly to the support leg or legs (5).

8. The floor covering according to claim 1, wherein the abutment legs (6) are provided with inwardly directed, longitudinally extending locking ribs (8).

9. The floor covering according to claim 8, wherein the insertion leg (12) is provided with outwardly projecting locking projections (14) which cooperate with the locking ribs (8).

10. The floor covering according to claim 1, wherein the abutment legs (6) have a substantially constant cross section in the longitudinal direction (L).

11. The floor covering according to claim 10, wherein the abutment legs (6) have a height (H) in the range from 4 to 30 mm.

12. The floor covering according to claim 10, wherein the abutment legs (6) have a width (B) in the range from 0.5 to 2 mm.

13. The floor covering according to claim 1, wherein the first profile element (3) and the second profile element (4) are each an extruded profile, the extruded profiles (4) being of the same cross-section.

14. The floor covering according to claim 1, wherein the compression legs (13) are provided with lateral recesses (15) extending in the longitudinal direction (L).

15. The floor covering according to claim 1, further comprising a cover element (2) that extends in the longitudinal direction (L), a width (b1) of which corresponds to a distance between outer surfaces of the abutment legs (6) and which can be detachably placed on the abutment legs (6) or is connected to at least one of the abutment legs (6) in the delivery state of the expansion joint profile (1), the connection having a predetermined breaking point in order to separate the cover element (2) from the abutment leg or legs (6).

16. The floor covering according to claim 15, wherein the cover element (2) is made of a fourth material, which is plastic.

17. A floor covering, comprising:

a profile (1) comprising a first profile element (3) having an L-shaped cross-section made of a first material, extending in a longitudinal direction (L) and having a first support leg (5) provided for bearing on a substrate (18) and a first abutment leg (6) connected to one of the longitudinal edges of the support leg (5) and projecting upwardly therefrom, a second profile element made of the first material (4) having a second abutment leg (6) which is formed to correspond to the first abutment leg (6) and extends parallel to the first abutment leg (6), and an elastic connection element (9) formed in a ridge-like manner made of a second material having different properties from the first material, the second material being a soft set silicone extending in the longitudinal direction between the two profile elements (3, 4), connecting them to one another in the lower region while allowing them move elastically relative to one another, and an insertion opening (10) formed between the abutment legs which is open at the top and extends in the longitudinal direction (L), at least two tiles or stone slabs, one each of which is installed atop a support leg (5) with end faces of the tiles or stone slabs in contact with the abutment legs (6); and a sealing element (11) made of an elastic material extending in the longitudinal direction (L), formed in a T-shaped cross-section with a downwardly projecting insertion leg (12) designed for insertion into the insertion opening (10).

18. The floor covering of claim 17, wherein the sealing element (11) includes two laterally projecting compression legs (13), wherein the compression legs (13), when the insertion leg (12) is disposed in the insertion opening (10), project outwardly above the abutment legs (6), respectively, the compression legs pressing against the end faces of the tile or stone slabs (16).

19. The floor covering of claim 17, wherein the end faces of the tiles or stone slabs (16) extend vertically above the abutment legs (6) when the end faces of the tiles or stone slabs (16) are in contact with the abutment legs (6).

* * * * *